US005943527A

United States Patent [19]

Kashiwagi et al.

[11] Patent Number: 5,943,527

[45] Date of Patent: Aug. 24, 1999

[54] DRUM UNIT AND EARTH PLATE USED IN THE DRUM UNIT

[75] Inventors: Nobuyuki Kashiwagi; Keizo Kimoto, both of Osaka; Tadashi Sakuma, Higashiosaka, all of Japan

[73] Assignee: Mita Industrial Co., Ltd., Osaka, Japan

[21] Appl. No.: 09/082,549

[22] Filed: May 21, 1998

[30] Foreign Application Priority Data

May 23, 1997 [JP] Japan ..... 9-133624

[51] Int. Cl.[6] ..... G03G 21/00

[52] U.S. Cl. ..... 399/90; 399/116; 174/51

[58] Field of Search ..... 399/159, 116, 399/117, 90, 167; 492/47; 174/51

[56] References Cited

U.S. PATENT DOCUMENTS

| | | | |
|---|---|---|---|
| 4,839,690 | 6/1989 | Onoda et al. | 399/117 |
| 5,052,090 | 10/1991 | Kitaura et al. | 492/47 X |
| 5,436,699 | 7/1995 | Komaki | 399/159 |
| 5,729,792 | 3/1998 | Ikehara | 399/90 |
| 5,752,136 | 5/1998 | Sanchez et al. | 399/117 |

FOREIGN PATENT DOCUMENTS 7-225531 8/1995 Japan .

OTHER PUBLICATIONS

Mita Drawings 1 and 2 of Ground Plate sold in US beginning Jul. 1994.

*Primary Examiner*—S. Lee

*Attorney, Agent, or Firm*—Shinjyu An Intellectual Property Firm

[57] ABSTRACT

A photosensitive drum unit for an electrostatographic printing apparatus is disclosed. The drum unit includes a drum tube formed with at least one opening at one axial end thereof. A flange member is configured to be inserted into the opening in the drum tube. The flange member is provided with a support hole into which a shaft pin is inserted for supporting the drum tube and flange member. An earth plate is formed with projections or claws that extend radially outward from a peripheral edge of the earth plate such that the projections contact with an inner peripheral surface of the drum tube. The earth plate is also formed with a pair of contact pieces extend axially away from the earth plate and also extend toward one another. The contact pieces are spaced apart from one another by a predetermined distance but are also configured to contact and engage a portion of the shaft pin.

26 Claims, 4 Drawing Sheets

DRUM UNIT AND EARTH PLATE USED IN THE DRUM UNIT

BACKGROUND OF THE INVENTION

A. Field of the Invention

The invention relates to a drum unit and an earth plate used in a drum unit which are employed in an image forming apparatuses, such as copying machines, laser printers and facsimile machines.

B. Description of the Related Art

In an image forming apparatus, for example a copying machine, an original image or document is usually read by an exposure section to form an electrostatic latent image on a photosensitive drum. A developing unit for forming toner image is disposed about an outer circumference of the photosensitive drum. The developing unit develops the read image by charging toner supplied from a toner hopper so that it has an electrostatic charge that is opposite that of the electrostatic latent image on the photosensitive drum. The toner adheres to the photosensitive drum at oppositely charged portions of the drum corresponding to the electrostatic latent image through a developing sleeve.

The photosensitive drum includes a drum tube which is obtained by forming a conductive metal into a cylindrical shape. A flange member is forced into openings at opposing ends of the drum tube to provide bearing sections about which the drum may rotate. A support hole is provided in the center of the flange member. A shaft pin for supporting the drum unit is inserted in the support hole.

To produce a conductive state between the drum tube and the apparatus body, an earth plate may be attached to the flange member. The earth plate has a radial outer peripheral contact portion that is configured to contact the inner peripheral surface of the drum tube. An inner peripheral surface of the earth plate is configured to be in contact with the periphery of the shaft pin. The drum tube may be made of aluminum or the like and coated with an oxidized insulating film, in order to prevent corrosion. To produce conductive state between the earth plate and the drum tube, it is therefore necessary to peel part of the oxidized insulating film, which presents contact area with the peripheral contact portion of the earth plate.

As the means to improve the earth plate contruction, there has been proposed the following construction. That is, an earth plate in which a peripheral contact portion has an outer diameter which is larger than the inside diameter of a drum tube. Such an earth plate is attached to an inside surface of a flange member. When the flange member is attached to the drum tube, the peripheral contact portion of the earth plate is forced in while it scratches the inner peripheral surface of the drum tube. A portion of the earth plate is bent toward an inner radial portion of the tube such that the bent portion contacts a shaft pin. As a drum unit rotates, the peripheral contact portion remains in sliding contact with the peripheral surface of the shaft pin, thereby producing conductive state between the earth plate and the shaft pin.

In the drum unit so constructed, the conductive state between the earth plate and the drum tube is produced by forcing the flange member attached to the earth plate into the openings of the drum tube. Also, the conductive state between the earth plate and the shaft pin is produced by fitting the support hole of the flange member in the shaft pin of the image forming apparatus so that the inner peripheral contact portion of the earth plate engages the shaft pin. At this time, the peripheral contact portion is forced in together with the flange member while it scratches the inner peripheral surface of the drum tube, and therefore, the earth plate receives the force in the direction in which the center of the earth plate expands inward the drum tube. Hence, the inner peripheral contact piece of the earth plate is provided so as to project from the opposite surface so as to be in contact with the flange member of the earth plate. As the earth plate is forced in the drum tube, its end receives the force in the direction away from the shaft pin. If the earth plate is deformed under such a force, it is liable to cause contact failure between the inner peripheral contact piece and the shaft pin.

With a single inner peripheral contact portion, the contact portion presses the shaft pin in one direction. As a result, a looseness between the shaft pin and the flange member may increase deflection in the rotation of the drum unit, and may cause contact failure between the shaft pin and the inner peripheral contact piece. To avoid these problems, if the pressure intensity of the inner peripheral contact piece to the shaft pin is increased, it may cause a rotational failure of the drum unit as well as a noticeable wear of the shaft pin.

SUMMARY OF THE INVENTION

One object of the present invention is to provide a drum unit and an earth plate that ensure constant conductive state between a drum tube and a shaft pin, and also minimize wear on the shaft pin.

In accordance with one aspect of the present invention, a photosensitive drum unit supported in an image reproducing device by a shaft pin includes a tubular member having at least one opening at one axial end thereof. The tubular member has an inner diameter. At least one flange member is connectable with the openings of the tubular member. The flange member is formed with a central opening through which the shaft pin may extend for supporting the tubular member and the flange member within the image reproducing device. An earth plate has a plate base that has a diameter smaller than the inner diameter of the tubular member and at least one projection which extends beyond an outer circumference of the plate base. The projection defines a diameter of the earth plate and the projection is formed with radially extending sides forming a cantilever-like configuration. The diameter of the earth plate is larger than the inner diameter of the tubular member. The plate base is formed a central opening through which the shaft pin may extend. The plate base is further formed with at least two contact pieces which extend from the outer circumference of the plate base. The contact pieces are formed with contact portions at distal ends thereof that are spaced apart from one another by a pre-determined distance that is less than the diameter of the plate base. The contact portions are spaced apart from the plate base and are configured to contact and engage the shaft pin.

Preferably, the central opening of the plate base is formed with a reinforcement support portion which extends in an axial direction outward from the plate base.

Preferably, the earth plate and the flange are fixed to one another and the reinforcement support portion is formed by a burring through the central opening in the flange member.

Preferably, the reinforcement support portion is formed by fixing a reinforcing material on the plate base in a vicinity of the central opening.

Preferably, a first of the two contact pieces is formed with a first of the contact portions and a second of the two contact pieces is formed with a second of the contact portions. The first and the second of the contact portions are spaced apart from the plate base by equal distances such that the contact portions are configured to contact the shaft pin a generally the same distance away from the plate base.

Optionally, the first and the second of the contact portions are spaced apart from the plate base by differing distances such that the first and the second of the contact portions are configured to contact the shaft pin different distances away from the plate base.

Preferably, the earth plate is formed with a plurality of the projections extending beyond an outer circumference of the plate base.

Preferably, the diameter of the plate base is defined at a bent portion of each of the contact pieces and the flange is formed with a plurality of axially extending projections which define a pitch circle P on the flange. The axially extending projections extend through corresponding holes formed in the plate base of the earth plate for retaining the earth plate on the flange. The pitch circle have a diameter that is at least as large as the diameter of the plate base.

Preferably, the projection on the plate base is further formed with a pointed tip at an end of the radially extending sides.

Preferably, the contact portions engage opposite sides of the shaft pin.

Preferably, the contact portions are spaced apart from one another by the pre-determined distance that is less than a diameter of the shaft pin.

Preferably, the earth plate is made of a stainless steel material.

When the flange member with the earth plate attached thereto is forced into the drum tube, it is possible to prevent the plate base of the earth plate from being deformed due to the force generated in the contact between the peripheral contact portion and the drum tube due to the support portion. This ensures steady conductive state between the inner peripheral contact portion and the shaft pin.

Because there are two contact portions in the present invention which contact opposite sides of the shaft pin, the reaction forces in the plate base are generally balanced, being approximately equal and thus deformation of the plate base when the shaft pin is inserted is avoided.

By using the earth plate in accordance with the present invention, it is possible to ensure steady conductive state between a drum tube and a shaft pin, leading to steady image formation in an image forming apparatus.

With the above described earth plate, the contact portions and the inner peripheral contact pieces produce steady conductive state between the shaft pin and the drum tube. When the contact portions are provided with differing spacing dimensions from the plate base, each inner peripheral contact piece comes into contact with the shaft pin in a different position, enabling reduction in the wear experienced by shaft pin.

These and other objects, features, aspects and advantages of the present invention will become more fully apparent from the following detailed description of the present invention when taken in conjunction with the accompanying drawings where like reference numerals denote corresponding parts throughout.

DESCRIPTION OF THE PREFERRED EMBODIMENTS

Figure 1:
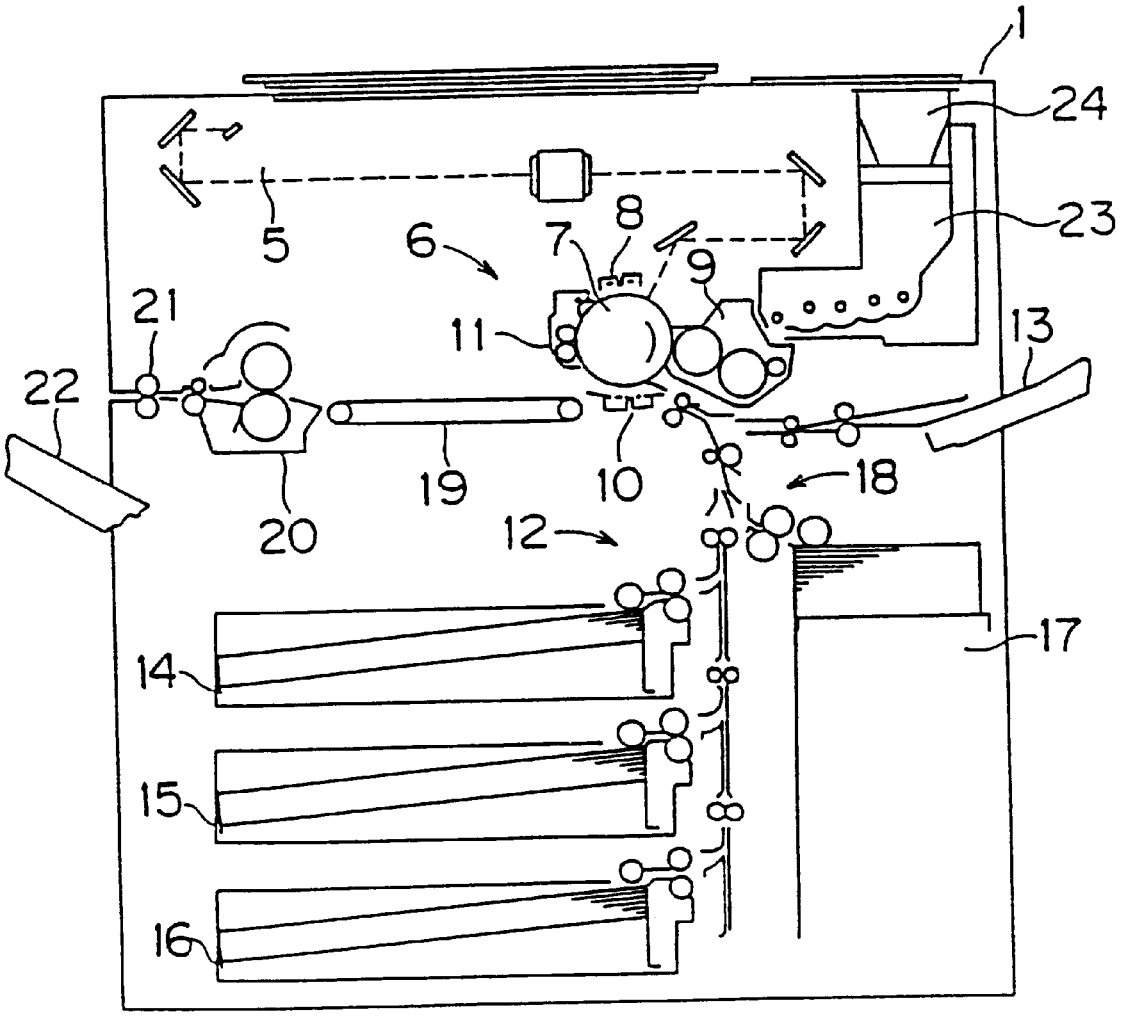
FIG. 1 is a longitudinal side schematic view of a copying machine which may employ the various embodiments of the present invention.

FIG. 1 is a longitudinal section of a copying machine to which one preferred embodiment of the present invention is applied.

Referring to FIG. 1, an exposure section 5 for reading or scanning an image on original document is disposed at an upper portion of a copying machine 1. The exposure section 5 includes a light source, a mirror, and a lens unit. An image forming section 6 for forming a toner image of a read original image is disposed in the center of the copying machine 1. The image forming section 6 has a photosensitive drum 7, on the surface of which an electrostatic latent image is formed. Around the photosensitive drum 7, there are provided a charging unit 8, a developing unit 9, a transfer/separation unit 10, and a cleaning unit 11.

A sheet feeding section 12 is provided in a lower part of the copying machine 1. The sheet feeding section 12 includes a bypass table 13 located on the right side of the copying machine 1 in FIG. 1, three sheet feeding cassettes 14, 15, 16 arranged longitudinally in a lower part of the copying machine 1, a large-sized sheet feeding cassette 17, and a sheet delivery unit 18 that conveys the sheets stocked in the bypass table 13 or the sheet feeding cassettes 14 to 17 to the image forming section 6. On a downstream side in the sheet conveyance direction of the image forming section 6, there are provided a sheet conveying path 19 for conveying sheets to the left side of the image forming apparatus in FIG. 1, a fixing unit 20 in which the toner image on a sheet is subjected to a melt fixing, a discharge roller 21 for discharging the sheet after being subjected to the fixing, and a sheet discharge tray 22 for receiving sheets to be discharged.

The developing unit 9 is equipped with a toner hopper 23 for supplying toner. A toner cartridge 24 which permits installation and removal is fitted into the toner hopper 23.

Figure 2:
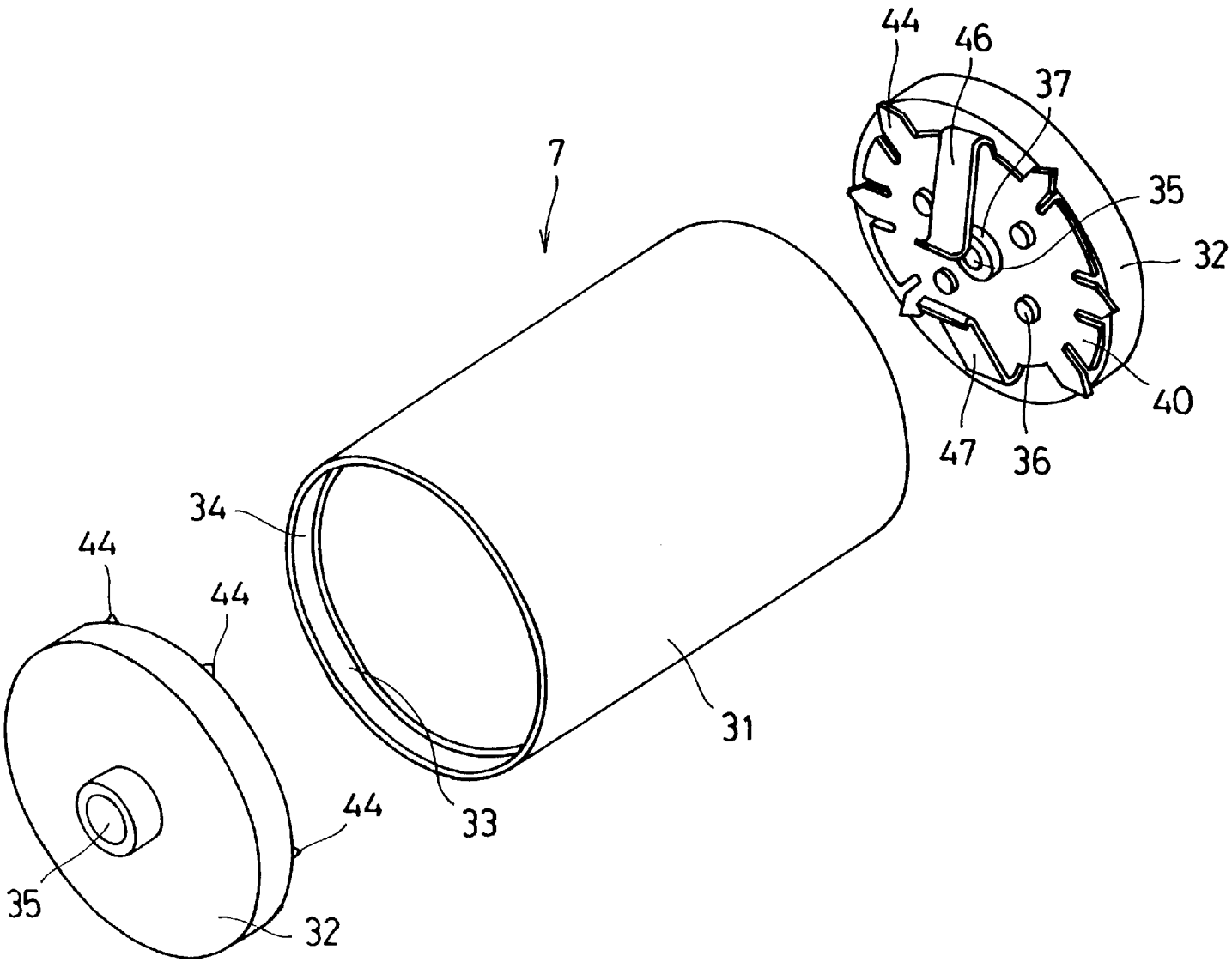
FIG. 2 is an exploded perspective view of a photosensitive drum used in a copying machine in accordance with a first embodiment of the present invention, the photosensitive drum including a flange member having an earth plate attached thereto.

Referring to FIG. 2, the photosensitive drum 7 has a drum tube 31 and flange members 32, 32. The drum tube 31 is obtained by forming a conductive metal into a cylindrical shape. For example, there can be employed those having a photosensitive layer of an organic photoconductor (OPC) formed on the peripheral surface of an aluminum based material.

Openings 33, 33 are formed on the ends of the drum tube 31, and flange fittings 34, 34 having a specific length and a small wall thickness are provided on the ends of the openings.

Figure 3:
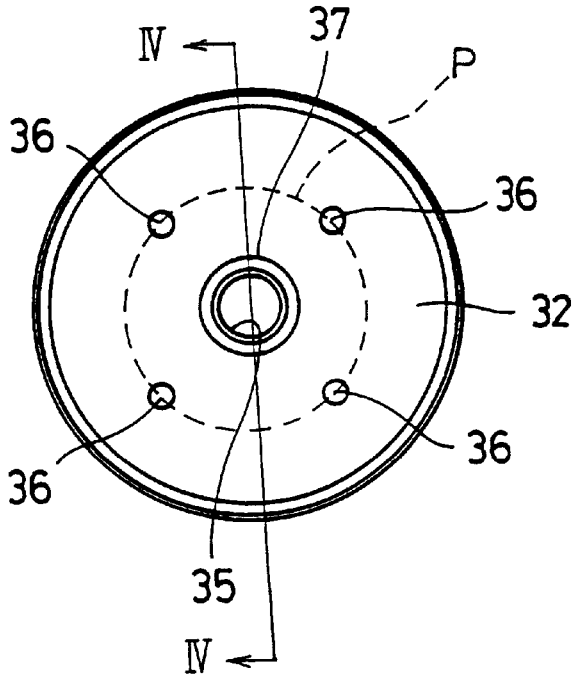
FIG. 3 is a front view of the flange member, with the flange member removed for greater clarity.
Figure 4:
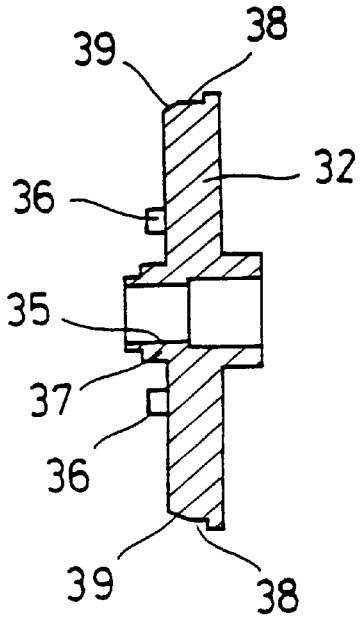
FIG. 4 is a longitudinal cross section of the flange member taken along the line IV—IV in FIG. 3.

Referring to FIGS. 3 and 4, the flange member 32 is described hereafter. The flange member 32 is obtained by forming a resin, e.g., POM, ADC, or the like, into an approximately disk shape, and its outside diameter is approximately equal to the inside diameter of the flange fitting 34 of the drum tube 31. Projections 36, 36 for fitting an earth plate are provided so as to project on the inside surface of the flange member 32. The projections 36 together define a pitch circle P of the flange member 32, the pitch circle P passing generally through the center of each projection 36. In a projection 37 that is provided so as to project in the center of the flange member 32, a support hole 35 is provided by punching. The support hole 35 is fitted in a shaft pin (not shown) which is disposed in the apparatus body in order to support a drum unit. The peripheral surface of the flange member 32 defines a contact portion 38 that is inserted in the flange fitting 34 of the drum tube 31. The inside surface of the flange member 32 has a chamfer 39 which has been chamfered so as to correspond to a cutting portion of an earth plate described later.

Figure 5:
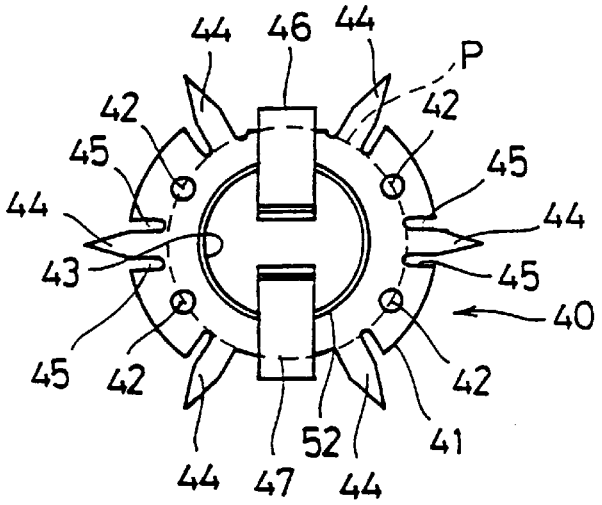
FIG. 5 is a front view of the earth plate shown removed from the flange member in accordance with the first embodiment of the present invention.
Figure 6:
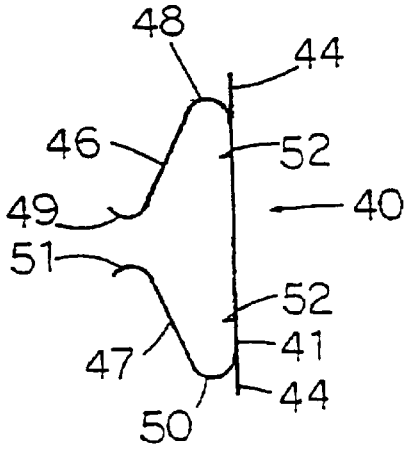
FIG. 6 is a side view of the earth plate depicted in FIG. 5.

An earth plate 40 made of a stainless steel is attached to the inside surface of the flange member 32. The earth plate 40 is described hereafter by referring to FIGS. 5 and 6. The earth plate 40 has a plate base 41 having an outside diameter smaller than the inside diameter of the flange fitting 34 of the drum tube 31. The earth plate 40 is equipped with fitting holes 42, 42, and a through hole 43, which correspond to the projections 36, 36, and 37, respectively.

The earth plate 40 is also equipped with claws 44, 44, whose end projects from the periphery of the plate base 41. The claws 44, 44 are so constructed that their ends are located outside the inside diameter of the flange fitting 34 of the drum tube 31, and are elastically deformable through cut-outs 45, 45 flanking the claws 44, 44.

The plate base 41 of the earth plate 40 is formed with two contact pieces 46, 47 that extend from an outer periphery of the plate base 41 but are bent radially inward from the outer periphery of the plate base 41. The contact pieces 46, 47 include bent portions 48, 50, respectively, which are bent from the plate base 41 such that they extend toward a center portion of the plate base 41. The ends of the bent portions 48, 50 are further bent such that they extend in an axial direction away from the plate base 41 to define contact portions 49, 51. The inner peripheral surfaces of the contact portions 49, 51 are spaced apart from one another by a distance that is slightly smaller than the diameter of a shaft pin that supports the flange member 32. Thus, when attached to the shaft pin, the contact portions 49, 51 are biased to engage the peripheral surface of the shaft pin. The contact portion 49 of the contact piece 46 and the contact portion 51 of the contact piece 47 are disposed so as to have the same distance from the plate base 41 so that they come into contact with the shaft pin in the generally same position in the longitudinal direction of the shaft pin.

A reinforced portion 52 that is disposed so as to project in the same axial direction as the contact pieces 46, 47, is provided in the vicinity of the through hole 43 of the plate base 41. The reinforced portion 52 can be formed at the same time the through hole 43 of the plate base 41 is formed by a heating and forcing a die through the plate base 41. The reinforced portion 52 reinforces the strength of the plate base 41 in the vicinity of the through hole 43 and also prevents the plate base 41 from being deformed under stress. Therefore, when the flange member 32 attached to the earth plate 40 is forced in the opening 33 of the drum tube 31, it is possible to prevent the plate base 41 from being deformed and thus ensure reliable contact between the shaft pin and the contact pieces 46, 47.

The earth plate 40 is attached to the inside surface of the flange member 32 by fitting the projections 36, 36 of the flange member 32 through fitting holes 42. The flange member 32 attached to the earth plate 40 is forced in the opening 33 of the drum tube 31, while the claws 44 of the earth plate 40 scratch the inside surface of the drum tube 31. Then, the oxidized insulating film on the inside surface of the drum tube 31 is peeled away by the claws 44, 44. As a result, the claws 44, 44 come into contact with the inner peripheral surface of the flange fitting 34 of the drum tube 31 and are therefore slightly elastically deformed, thereby producing electrical conductability between the earth plate 40 and the drum tube 31.

After attaching the flange members 32, 32 to the ends of the drum tube 31, the shaft pin is fitted into the respective support holes 35, 35 provided on the apparatus body. At this time, the contact portions 49, 51 of the contact pieces 46, 47 on the earth plate 40 press the shaft pin, so that the electrical conductibility between the earth plate 40 and the shaft pin is obtained. In this case, the contact portions 49, 51 deflect somewhat due to the reaction force from the shaft pin, however, because they have the same length, the force applied to the plate base 41 becomes approximately equal and thus prevents the deformation of the plate base when the shaft pin is inserted.

Although the above preferred embodiment demonstrates a photosensitive drum used in a copying machine, the present invention is also applicable to photosensitive drums used in laser printers, facsimiles, or the like.

As a drum tube, it is possible to employ various type ones, e.g., those made of a stainless steel, those in which a photosensitive layer made of an inorganic photosensitive material or the like, is formed on the peripheral surface.

It is possible to avoid the possibility of a drum tube from going out of round by using an earth plate made of copper or copper alloy.

Although in the above described embodiment there are two opposed contact pieces disposed to engage opposite side of the shaft pin, it is the present invention is intended to include multiple contact pieces where three, four, five or more contact pieces may be arranged around the shaft pin.

A reinforced portion, i.e. the portion 52, may be made by fixing other material in the vicinity of a through hole of a plate base. For instance, a reinforcing material may be adhered to the plate base 41 by welding, adhesion using an adhesive, and lapped flat seam.

Second Embodiment

Figure 7:
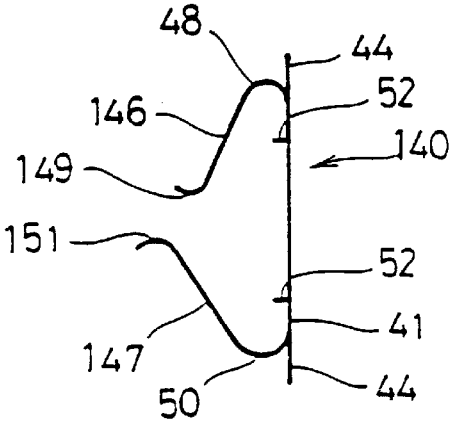
FIG. 7 is a side view of an earth plate in accordance with a second embodiment of the present invention.

A second embodiment of the present invention is depicted in FIG. 7. In FIG. 7, an earth plate 140 includes many of the features of the first embodiment, such as the plate base 41, support portion 52 and the claws 44. However, the earth plate 140 of the second embodiment includes contact pieces 146, 147 that are not symmetrical. Specifically, the contact piece 147 is bent such that it extends an axial distance away from the plate base 41 that is greater than the axial distance between the plate base 41 and the contact piece 146. Therefore the contact portions 49 and 51 contact the shaft pin (not shown) in different axial positions. In this case, the contact portions 149, 151 of the contact pieces 146, 147 are in contact with the shaft pin in a different position in the longitudinal direction of the shaft, thereby reducing possible wear of the shaft pin in the contact portion with the contact pieces 146, 147.

In the drum unit according to the present invention, a reinforced portion on an earth plate prevents a plate base from being deformed, thereby preventing contact failure between the inner peripheral contact portion and a shaft pin.

When a flange member attached to the earth plate is forced in a drum tube, a peripheral contact portion scratches the inner peripheral surface of the drum tube. Therefore, the stress generated at that time may be applied to the plate base. However, thanks to the reinforced portion, it is possible to prevent the plate member from being deformed.

In addition, when the earth plate used in a drum unit in accordance with the present invention is used in the drum unit of an image forming apparatus or the like, a favorable earth of a drum tube is maintained to prevent noise from occurring at image formation.

In the drum unit according to the present invention, a plurality of inner peripheral contact pieces on the earth plate are arranged so as to contact with the shaft pin in a different position in the longitudinal direction of the shaft pin, and therefore, each contact piece slides a different position of the shaft pin. This permits a reduction of the wear of the shaft pin and ensures steady conductive state between the shaft pin and the drum tube.

In the earth plate used in a drum unit according to the present invention, a plurality of inner peripheral contact pieces on the earth plate are disposed so as to contact with the shaft pin in a different position in the longitudinal direction of the shaft pin. Therefore, the each contact piece slides a different position of the shaft pin, resulting in that the wear of the shaft pin is reduced to produce steady conductive state between the shaft pin and the drum tube. Thus, by using this earth plate in the drum unit of an image forming apparatus or the like, it is possible to maintain a favorable earth of the drum tube and thus prevent noise from occurring at image formation.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A photosensitive drum unit supported in an image reproducing device by a shaft pin, comprising:

a tubular member having at least one opening at one axial end thereof, said tubular member having an inner diameter, at least one flange member connectable with said openings of said tubular member, said flange member being formed with a flange central opening through which the shaft pin may extend for supporting said tubular member and said flange member within the image reproducing device, and an earth plate having a plate base that has a diameter smaller than said inner diameter of said tubular member, at least one projection which extends beyond an outer circumference of said plate base, said projection defining a diameter of said earth plate, said projection formed with radially extending sides forming a cantilever-like configuration, said diameter of said earth plate being larger than said inner diameter of said tubular member; and wherein said plate base is formed a plate central opening through which the shaft pin may extend, said plate base further formed with at least two contact pieces which extend from said outer circumference of said plate base, said contact pieces formed with contact portions at distal ends thereof that are spaced apart from one another by a pre-determined distance that is less than said diameter of said plate base and said contact portions are spaced apart from said plate base, said contact portions being configured to contact and engage the shaft pin.

2. The photosensitive drum unit as in claim 1, wherein said central opening of said plate base is formed with a reinforcement support portion which extends in an axial direction outward from said plate base.

3. The photosensitive drum unit as in claim 2, wherein said earth plate and said flange member are fixed to one another and said reinforcement support portion is formed by burring in forming said plate central opening.

4. The photosensitive drum unit as in claim 2 wherein the reinforcement support portion is formed by fixing a reinforcing material on said plate base in a vicinity of said central opening.

5. The photosensitive drum unit as in claim 1, wherein a first of said two contact pieces is formed with a first of said contact portions and a second of said two contact pieces is formed with a second of said contact portions, said first and said second of said contact portions being spaced apart from said plate base by equal distances such that said contact portions are configured to contact the shaft pin a generally the same distance away from said plate base.

6. The photosensitive drum unit as in claim 1, wherein a first of said two contact pieces is formed with a first of said contact portions and a second of said two contact pieces is formed with a second of said contact portions, said first and said second of said contact portions being spaced apart from said plate base by differing distances such that said first and said second of said contact portions are configured to contact the shaft pin different distances away from said plate base.

7. The photosensitive drum unit as in claim 1, wherein said earth plate is formed with a plurality of said projections extending beyond an outer circumference of said plate base.

8. The photosensitive drum unit as in claim 1, wherein said diameter of said plate base is defined at a bent portion of each of said contact pieces and said flange member is formed with a plurality of axially extending projections which define a pitch circle P on said flange member, said axially extending projections extending through corresponding holes formed in said plate base of said earth plate for retaining said earth plate on said flange member, said pitch circle having a diameter that is at least as large as said diameter of said plate base.

9. The photosensitive drum unit as in claim 1, wherein said projection on said plate base is further formed with a pointed tip at an end of said radially extending sides.

10. The photosensitive drum unit as in claim 1 wherein said contact portions engage opposite sides of the shaft pin.

11. The photosensitive drum unit as in claim 1 wherein said contact portions are spaced apart from one another by said pre-determined distance that is less than a diameter of the shaft pin.

12. The photosensitive drum unit as in claim 1 wherein said earth plate is made of a stainless steel material.

13. A photosensitive drum unit supported in an image reproducing device by a shaft pin, comprising:

a tubular member having at least one opening at one axial end thereof, said tubular member having an inner diameter, at least one flange member connectable with said openings of said tubular member, said flange member being formed with a flange central opening through which the shaft pin may extend for supporting said tubular member and said flange member within the image reproducing device, and an earth plate having a plate base that has a diameter smaller than said inner diameter of said tubular member, at least one projection which extends beyond an outer circumference of said plate base, said projection defining a diameter of said earth plate, said projection formed with radially extending sides forming a cantilever-like configuration, said diameter of said earth plate being larger than said inner diameter of said tubular member; and wherein said plate base is formed a plate central opening through which the shaft pin may extend, said plate base further formed with a reinforcement support portion about said central opening and contact pieces which extend from said outer circumference of said plate base, said contact pieces being configured for contact and engagement with the shaft pin.

14. The photosensitive drum unit as in claim 13, wherein said plate base is further formed with two of said contact pieces, each of said contact pieces being formed with contact portions at distal ends thereof that are spaced apart from one another by a pre-determined distance that is less than said diameter of said plate base and said contact portions are spaced apart from said plate base, said contact portions being configured to contact and engage the shaft pin.

15. The photosensitive drum unit as in claim 13, wherein said reinforcement support portion has a generally cylindrical shape and extends in an axial direction outward from said plate base.

16. The photosensitive drum unit as in claim 15, wherein said earth plate and said flange member are fixed to one another and said reinforcement support portion is formed by burring in forming said plate central opening.

17. The photosensitive drum unit as in claim 15, wherein the reinforcement support portion is formed by fixing a reinforcing material on said plate base in a vicinity of said central opening.

18. The photosensitive drum unit as in claim 14, wherein a first of said two contact pieces is formed with a first of said contact portions and a second of said two contact pieces is formed with a second of said contact portions, said first and said second of said contact portions being spaced apart from said plate base by equal distances such that said contact portions are configured to contact the shaft pin a generally the same distance away from said plate base.

19. The photosensitive drum unit as in claim 14, wherein a first of said two contact pieces is formed with a first of said contact portions and a second of said two contact pieces is formed with a second of said contact portions, said first and said second of said contact portions being spaced apart from said plate base by differing distances such that said first and said second of said contact portions are configured to contact the shaft pin different distances away from said plate base.

20. The photosensitive drum unit as in claim 13, wherein said earth plate is formed with a plurality of said projections extending beyond said outer circumference of said plate base.

21. The photosensitive drum unit as in claim 14, wherein said diameter of said plate base is defined at a bent portion of each of said contact pieces and said flange member is formed with a plurality of axially extending projections which define a pitch circle P on said flange member, said axially extending projections extending through corresponding holes formed in said plate base of said earth plate for retaining said earth plate on said flange member, said pitch circle having a diameter that is at least as large as said diameter of said plate base.

22. The photosensitive drum unit as in claim 13, wherein said projection on said plate base is further formed with a pointed tip at an end of said radially extending sides.

23. The photosensitive drum unit as in claim 14, wherein said contact portions engage opposite sides of the shaft pin.

24. The photosensitive drum unit as in claim 14 wherein said contact portions are spaced apart from one another by said pre-determined distance that is less than a diameter of the shaft pin.

25. The photosensitive drum unit as in claim 13 wherein said earth plate is made of a stainless steel material.

26. A photosensitive drum unit for installation on a bearing shaft in an image reproducing device, said photosensitive drum unit comprising:

an open-ended photosensitive tubular member defining an inner diameter;

at least one flange member insertable endwise into said tubular member, said flange member being formed with a flange central opening for mounting said flange member on a bearing shaft within an image reproducing device;

a grounding plate formed with a plate base of diameter less than the tubular member inner diameter, at least one tab projecting from said plate base, said tab in radial extension defining a diametrical dimension of said grounding plate greater than said tubular member inner diameter, a plate central opening dimensioned for receiving the bearing shaft, and at least two bearing-shaft contact elements formed circumferentially on and extending axially from said plate base and distally separated by a distance less than the diameter of said plate base, for retentively mounting said grounding plate on the bearing shaft.

* * * * *